US006068758A

United States Patent [19]

Strausz

[11] Patent Number: 6,068,758

[45] Date of Patent: May 30, 2000

[54] PROCESS FOR HYDROCRACKING HEAVY OIL

[76] Inventor: Otto P. Strausz, 13119 Grandview Drive, Edmonton, Alberta, Canada, T6H 4K7

[21] Appl. No.: 08/873,734

[22] Filed: Jun. 12, 1997

Related U.S. Application Data

[63] Continuation-in-part of application No. 08/698,989, Aug. 16, 1996, abandoned.

[51] Int. Cl.[7] ..... C10G 47/02

[52] U.S. Cl. ..... 208/108; 208/112; 208/44; 208/40

[58] Field of Search ..... 208/108, 112, 208/44, 40

[56] References Cited

U.S. PATENT DOCUMENTS

| | | | |
|---|---|---|---|
| 4,125,455 | 11/1978 | Herbstman | 208/108 |
| 4,134,825 | 1/1979 | Bearden, Jr. et al. | 208/108 |
| 4,592,827 | 6/1986 | Galiasso et al. | 208/59 |
| 4,695,369 | 9/1987 | Garg et al. | 208/108 |
| 5,372,705 | 12/1994 | Bhattacharya et al. | 208/112 |

*Primary Examiner*—Walter D. Griffin
*Assistant Examiner*—Nadine Preisch
*Attorney, Agent, or Firm*—Millen, White, Zelano & Branigan, P.C.

[57] ABSTRACT

The catalyst comprises a mixture of hydrocracked residual asphaltene and metal-doped coke. The catalyst is produced by mixing an oil-soluble metal compound catalyst precursor (e.g. Mo or Ni soap) with heavy oil containing asphaltene and hydrocracking the mixture, producing solid coke as a byproduct. The residual asphaltene fraction in the hydrocracked oil is then precipitated, for example with n-pentane. The mixture of solid coke and precipitated asphaltene is separated and used as the catalyst for hydrocracking a new batch of non-hydrocracked oil. The coke and asphaltene mixture provides as effective a catalyst as the original metal soap catalyst precursor. The coke and asphaltene mixture recovered from a second stage of coke and asphaltene mixture catalysed hydrocracking of heavy oil is still an effective catalyst and can be used again without significant loss in catalytic activity. Similarly, coke and asphaltene mixture from non-catalytic hydrocracking of bitumen displays a catalytic effect which, however, is lower than that described above.

9 Claims, No Drawings

PROCESS FOR HYDROCRACKING HEAVY OIL

CROSS-REFERENCE TO RELATED APPLICATION

This application is a continuation-in-part of application Ser. No. 08/698,989 filed on Aug. 16, 1996, which is hereby incorporated by reference in its entirety now abandoned.

FIELD OF THE INVENTION

This invention relates to catalysts for hydrocracking heavy oil and to using such catalysts in a hydrocracking process. The catalyst comprises a synergistic mixture of coke and residual asphaltene derived from hydrocracking of heavy oil. More particularly it relates to catalysts derived from the step of hydrocracking heavy oil using oil-soluble nickel or molybdenum compounds as the catalyst precursor. This catalyst comprises a mixture of metal-doped coke and residual asphaltene produced and isolated from that step.

BACKGROUND OF THE INVENTION

Published research has disclosed that oil-soluble metal compounds can be added to heavy oil to be hydrocracked, to form catalytic particles in situ at hydrocracking conditions.

The most effective metals for this purpose are molybdenum and nickel. Oil-soluble compounds that have been shown to be suitable for this purpose are metal soaps, such as molybdenum naphthenate and nickel di-2-ethylhexanoate.

These metal catalyst precursors can be provided in small concentration, typically 50 to 300 ppm.

At these levels of concentration, the catalyst comes close to being useful on a throw-away basis. This is attractive because there is therefore no need to regenerate the catalyst.

However, the cost of the metal catalyst precursors is sufficiently high so that they have not yet been applied commercially.

There is thus a need to reduce the amount of such metal catalyst precursor required for hydrocracking a given amount of feed oil. It is an object of this invention to achieve that end.

Prior art of interest to the present invention will now be discussed.

U.S. Pat. No. 4,134,825, issued Jan. 16, 1979, to Bearden et al discloses dispersing an oil-soluble catalyst precursor (such as molybdenum naphthenate) in heavy oil and hydrocracking the mixture in a reactor. The patent states that the produced coke in the hydrocracked oil may be separated and recycled to the reactor. It further states that part of the hydrocracking oil (which contains the dissolved residue asphaltene) may also be recycled to the reactor. It will be noted that the patent does not teach separating or isolating the residue asphaltene from the hydrocracked oil.

SUMMARY OF THE INVENTION

In research underlying the present invention, it has been discovered that the metal in a metal soap catalyst precursor will chemically react with the micellarly dispersed asphaltene in bitumen. This reaction takes place readily, quickly and, more importantly, irreversibly. The reaction appears to involve ligand exchange and molecular complexation mechanisms binding the metal (present in the experiments as $MoOz_2^{2+}$ or $Ni^{2+}$) to the asphaltene micelle. It is believed that the product takes the form of a micelle-metal complex and it is the decomposition of this complex at hydrocracking conditions that yields the metal oxide/sulfide particles that are catalytic.

It was reasoned that the strong chemical affinity between the metal and asphaltene might survive the hydrocracking step. If so, this raised the possibility that the metal might remain bonded to the asphaltenes or to the coke formed from it, through hydrocracking. If so, then the hydrocracked residual asphaltenes remaining in the hydrocracked oil or the coke formed during hydrocracking might have catalytic activity.

A testing program was therefore initiated to assess the catalytic activity of each of the metal-doped coke and the hydrocracked residual asphaltenes produced from a hydrocracking operation utilizing the previously described catalyst precursors. Each of the coke and the residual asphaltene was individually separated from the hydrocracked oil. It was found that coke alone was only weakly catalytic and asphaltene alone was non-catalytic. However, when a mixture of coke and asphaltene from this first stage of hydrocracking was tested, it was surprisingly discovered that the mixture was strongly catalytic. The mixture had a level of catalytic activity equivalent to that of the precursor itself. In addition, when a mixture of coke and asphaltene derived from a second stage of hydrocracking using a coke plus residual asphaltene catalyst was tested, it too was found to have a level of catalytic activity substantially equivalent to that of the precursor itself. Even third stage derived coke and asphaltene mixture retained as catalytic activity at the same high levels as above.

(By "first stage" is meant hydrocracking wherein metal soap is the catalyst precursor. When a mixture of coke and residual asphaltene isolated from this first stage is used as the catalyst in hydrocracking a now batch of non-hydrocracked oil, this operation is referred to as "second stage" hydrocracking.)

Moreover, it was also discovered that the mixture of straight coke and residual asphaltene separated from non-catalytic hydrocracking of heavy oil also possessed a lower level of catalytic activity for the hydrocracking of heavy oil. Separated straight coke or residual asphaltene, however, individually showed no beneficial catalytic activity. The separated mixture derived from non-catalytic hydrocracking appears to acquire its catalytic activity from the high, naturally-occurring metal concentrations in the asphaltene fraction of the heavy oil.

In summary then, there is a synergistic effect realized when a mixture of separated coke, either metal-doped or straight, and residual asphaltene, each derived from first or second or third stage hydrocracking, is used as the catalyst. In addition, there is an on-going preservation of catalytic activity of the coke and asphaltene mixture. These constitute surprising and unforeseen discoveries.

In one broad aspect, the invention is a catalytic hydrocracking process for heavy oil containing native asphaltene comprising separating coke and residual asphaltene from hydrocracked oil; mixing a mixture of the separated coke and residual asphaltene with non-hydrocracked heavy oil to produce a feedstock for hydrocracking and reacting the feedstock with hydrogen at hydrocracking temperature and pressure to produce hydrocracked oil.

In another broad aspect, the invention is a catalytic hydrocracking process for heavy oil containing native asphaltene. The process comprises: mixing an oil-soluble metal compound catalyst precursor, selected from the group consisting of molybdenum and nickel compounds, with non-hydrocracked heavy oil and reacting the resulting mixture with hydrogen at hydrocracking temperature and pressure whereby the oil is hydrocracked and metal-doped coke and hydrocracked residual asphaltene are produced; separating the coke and asphaltene from the hydrocracked oil; mixing a mixture of the separated coke and asphaltene with non-hydrocracked heavy oil to produce a feedstock for hydrocracking; and reacting the feedstock with hydrogen at hydrocracking temperature and pressure to produce hydrocracked oil.

By repeated use of a single batch of metal in this way, one can double, triple or otherwise multiply the amount of heavy oil that can be hydrocracked using that batch of metal.

Other advantages shown to have been derived from hydrocracking using the metal-doped coke and residual asphaltene mixture catalyst include: reduction in coke production and gas formation, reduction in asphaltene content of the product oil, increased maltene content of the product oil, reduced heteroatom (oxygen, sulfur, nitrogen and metals) content of the product oil and reduced viscosity and density of that oil.

DESCRIPTION OF THE PREFERRED EMBODIMENT

The invention is supported by a series of experimental runs, now described.

The heavy oil used in all of the experiments was Athabasca coker feed bitumen obtained from the Syncrude Canada Ltd. plant. This feed typically contains about 17% by weight native asphaltene and has a viscosity of 1,030.0 cps at 60° C. The catalysts invented here can also be used in the hydrocracking of other heavy oil feedstocks such as Cold Lake heavy oil, Alberta bitumens and bitumens in general. The term "heavy oil" used herein is intended to encompass bitumen and oil having densities>0.90 g/mL at 20° C. and viscosities>4.0 cps at 60° C.

Molybdenum was supplied in the form of molybdenum acetylacetonate ($MoO_2(acac)_2$), obtained from Aldrch. This yellowish-green solid is soluble in methanol but not in n-pentane. A stock solution was made by dissolving 170.0 mg in 10.0 mL methanol.

Nickel was supplied in the form of nickel-di-2-ethylhexanoate prepared from $Ni(OH)_2$ and 2-ethylhexanoic acid as described by H. H. Chen, D. S. Montgomery and O. P. Strausz, AOSTRA J. Res., 4, (1988) 45. A stock solution was made by dissolving 170 mg in 10 mL n-pentane.

The invention preferably utilizes oil-soluble Mo and Ni compounds as catalyst precursors. Compounds suitable for this purpose include metal acetylacetonates, 2-ethylhexanoates, propionates, butyrates, stearates and mixtures thereof.

The hydrocracking runs were carried out in an Autoclave Engineers 300 mL autoclave equipped with a stirrer, a thermocouple well, an electric heater and an internal water cooling coil.

Bitumen was introduced into a 200 mL pre-weighed beaker and weighed. The bitumen was then introduced into the autoclave well. The weight of the beaker plus residual asphaltene was determined afterwards and the amount of bitumen placed in the autoclave calculated.

The amount of metal catalyst added to the well was based on the amount of bitumen added, to provide a metal concentration of 300 ppm. No solvent was used to disperse the catalyst.

The autoclave was first charged with hydrogen and vented, each cycle being repeated three or four times in order to remove entrapped air. It was then charged with hydrogen at 2000 psi and allowed to stand for 15 minutes. The autoclave heater was then turned on at a heating rate of 13° C./minute, to bring the autoclave contents to 425° C. within about 30 minutes. During this period, the stirrer was operated. Hydrocracking at 425° C. was continued for 1 hour. The heat was then turned off, water was passed through the internal coil and the temperature dropped rapidly to about 100° C. in 5 minutes. The autoclave was then equilibrated to room temperature overnight.

The unreacted hydrogen and any gases were then vented to an exhaust system. The autoclave cap was removed and the hydrocracked reaction mixture was removed from the autoclave with a pipette. The last traces of soluble and suspendible products were removed with the aid of added $CH_2Cl_2$.

The noxious-smelling hydrocracked reaction mixture was allowed to settle in the fume hood for about an hour prior to filtering through a 25–50$\mu$ sintered glass funnel. The solid material in the funnel was washed with $CH_2Cl_2$ until the washings were colourless. The solid material was then air-dried for about 2 hours prior to weighing. The solid material was coke and is referred to herein as "metal-doped coke" from the metal-catalyzed hydrocracking and "straight" from non-catalyzed hydrocracking.

The filtrate was concentrated on a rotary evaporator with the water bath at room temperature, to a weight of ~50 g. To this concentrate was added about 35 mL of $CH_2Cl_2$. Into this stirred solution was slowly added, with stirring, 1500 mL of n-pentane (>40-fold volume excess) to precipitate the contained hydrocracked residual asphaltene. The resulting mixture was kept in a refrigerator overnight.

The asphaltene was separated by filtering the mixture through a weighed 4–8-$\mu$ it sintered glass funnel. It was washed with n-pentane until the washings were colourless and air-dried for 2 hours prior to weighing.

The filtrate, containing the maltene, was processed using two different procedures.

In most experiments, the filtrate was concentrated to constant weight on the rotary evaporator with the water bath at 23° C.

In some experiments, in order to minimize the loss of volatile products, the maltene fraction was concentrated at 200 Torr pressure and at 20° C. for a predetermined time. Under such conditions compounds with boiling points exceeding about 55° C. could be retained, along with small quantities of the solvent $CH_2Cl_2$. Correction for the residual $CH_2Cl_2$ was made by determining the chlorine content of the maltene.

In experiments wherein the coke+asphaltenes were recovered together, the asphaltene precipitation, filtering and drying procedures were as above but with the omission of the prior filtering of the coke alone.

It will be noted that the metal-doped coke and the residual asphaltene were both separated or isolated from the hydrocracked oil. They were recovered as individual fractions and later blended to yield the catalytic mixture of the invention. Alternatively they were recovered as a mixture from the hydrocracked oil. Both procedures are considered to be within the scope of the process.

Hydrocracking experiments with metal-doped coke alone, asphaltene alone and metal-doped coke+residual asphaltene mixture as catalysts were carried out using the same protocol as with the oil-soluble metal catalyst precursor described above but instead of the oil-soluble metal, either metal-doped coke, asphaltene or their mixtures obtained in previous hydrocracking experiments were employed. Hydrocracking experiments involving straight coke were performed using the same protocol as with the corresponding metal-doped coke.

TABLE I

Hydrocracking of Athabasca bitumen containing 16.2 wt % asphaltene and 83.8 wt. % maltene (of bitumen)*

| Run | Catalyst | Product: Coke (wt. % of bitumen | Asphaltene (wt. % of bitumen | Maltene (wt. % of bitumen | Gas and Volatiles (wt. % of bitumen |
|---|---|---|---|---|---|
| (1) | None | 1.63 | 7.7 | 70.7 | 20.7 |
| (2) | None | 2.05 | 6.5 | 73.2 | 18.3 |
| (3) | None | 1.99 | 6.1 | 72.3 | 19.5 |
| (4) | 300 ppm Mo | 1.17 | 3.6 | 85.1 | 10.1 |
| (5) | 300 ppm Mo | 1.27 | 4.1 | 86.7 | 7.9 |
| (6) | coke from (4) | 1.07 | 5.2 | 74.8 | 19.0 |
| (7) | coke from (5) | 0.83 | 4.4 | 73.6 | 21.1 |
| (8) | asphaltene from (4) | 5.73 | 4.7 | 70.6 | 19.0 |
| (9) | coke + asphaltene | 1.13 | 3.2 | 87.1 | 8.5 |
| (10) | coke + asphaltene from (9) | 1.14 | 3.0 | 86.6 | 9.2 |
| (11) | coke + asphaltene from (10) | 1.26 | 2.9 | 86.4 | 9.4 |
| (12) | 300 ppm Mo | 1.16 | 4.3 | 86.6 | 7.9 |
| (13) | coke + asphaltene from (12) | 0.83 | 3.5 | 87.1 | 8.6 |
| (14) | None | 2.05 | 6.5 | 73.2 | 18.7 |
| (15) | coke + asphaltene from (14) | 1.50 | 3.7 | 79.1 | 15.7 |
| (16) | None | 4.11 | 6.6 | 70.9 | 18.4 |
| (17) | coke from (16) | 1.80 | 6.9 | 71.1 | 20.2 |
| (18) | asphaltene from (16) | 8.78 | 2.7 | 70.8 | 19.8 |
| (19) | 800 ppm Ni | 2.42 | 6.0 | 82.0 | 9.6 |
| (20) | coke from (19) | 1.62 | 6.4 | 77.6 | 14.4 |
| (21) | asphaltene from (19) | 6.08 | 3.9 | 71.5 | 18.5 |
| (22) | coke + asphaltene from repeat of (19) | 1.65 | 4.0 | 81.4 | 13.0 |

*ppm metal concentrations are based on the weight of bitumen hydrocracked.

The experiments with dispersed Ni as catalyst were carried out in exactly the same manner as with Mo as dispersed catalyst but instead of the $MoO_2(acac)_2$ stock solution the Ni-di-2-ethyl-hexanoate stock solution was used.

The results from the runs are set forth in Table I.

The following conclusions can be taken from Table I:

coke+asphaltene from non-catalytic hydrocracking has a moderate catalytic effect (see runs (14)–(18)). The catalytic effect appears to be due to the high contents of metals naturally present in the native asphaltene (Ni-250 ppm; Mo-12 ppm; V-700 ppm etc.). Coke alone or asphaltene alone has no beneficial effect (see runs (17) and (18));

300 ppm Mo has a high catalytic activity (see runs (1)–(3) versus runs (4), (5));

the metal-doped coke+residual asphaltene mixture, from hydrocracking runs using Mo soap catalyst precursor as the original catalyst, proved to be as effective a catalyst for hydrocracking as the 300 ppm Mo supplied as precursor (see runs (4), (5) and (9), (11));

the metal-doped coke+residual asphaltene mixture from hydrocracking runs using metal-doped coke+asphaltene mixture from Mo catalysed hydrocracking of bitumen as the catalyst, proved to be as effective a catalyst for hydrocracking as the 300 ppm Mo (see run (10));

Ni at the 300 ppm level is a less effective catalyst than Mo (see runs (4), (5) and (19));

the metal-doped coke from the 300 ppm Ni-catalysed hydrocracking, while having a catalytic effect, is less efficient than Ni itself (see runs (19) and (20)); and the metal-doped coke+asphaltene mixture from the 300 ppm Ni-catalysed hydrocracking of the bitumen is nearly as efficient a catalyst as Ni (see runs (19) and (22)).

The embodiments of the invention in which an exclusive property or privilege is claimed are defined as follows:

1. A catalytic hydrocracking process for heavy oil containing native asphaltene, comprising:

separating coke and residual asphaltene from hydrocracked oil;

mixing a mixture of the separated coke and residual asphaltene with non-hydrocracked heavy oil to produce a feedstock for hydrocracking; and reacting the feedstock with hydrogen at hydrocracking temperature and pressure to produce hydrocracked oil.

2. A catalytic hydrocracking process for heavy oil containing native asphaltene, comprising:

mixing an oil-soluble metal compound catalyst precursor, selected from the group consisting of molybdenum and nickel compounds, with non-hydrocracked heavy oil and reacting the resulting mixture with hydrogen at hydrocracking temperature and pressure whereby the oil is hydrocracked and metal-doped coke and hydrocracked residual asphaltene are produced;

separating the metal-doped coke and hydrocracked residual asphaltene from the hydrocracked oil;

mixing a mixture of the separated coke and asphaltene with non-hydrocracked heavy oil to produce a feedstock for hydrocracking; and reacting the feedstock with hydrogen at hydrocracking temperature and pressure to produce hydrocracked oil.

3. A catalytic hydrocracking process for heavy oil containing native asphaltene, comprising:

mixing an oil-soluble metal compound catalyst precursor, selected from the group consisting of molybdenum and nickel compounds, with non-hydrocracked oil and reacting the resulting mixture with hydrogen at hydrocracking temperature and pressure whereby the oil is hydrocracked and metal-doped coke and hydrocracked residual asphaltene are produced;

separating the metal-doped coke from the hydrocracked oil;

precipitating hydrocracked residual asphaltene from the hydrocracked oil;

separating precipitated asphaltene from the oil;

mixing a mixture of separated metal-doped coke and precipitated asphaltene with non-hydrocracked heavy oil to produce a feedstock for hydrocracking; and reacting the feedstock with hydrogen at hydrocracking temperature and pressure to produce hydrocracked oil.

4. A process according to claim 1, wherein no additional catalyst is added to the mixture of separated coke and residual asphaltene.

5. A process according to claim 2, wherein no additional catalyst is added to the mixture of separated coke and residual asphaltene.

6. A process according to claim 3, wherein no additional catalyst is added to the mixture of separated coke and residual asphaltene.

7. A process according to claim 1, wherein the feedstock consists of the mixture of separated coke, residual asphaltene and non-hydrocracked heavy oil.

8. A process according to claim 2, wherein the feedstock consists of the mixture of separated coke, residual asphaltene and non-hydrocracked heavy oil.

9. A process according to claim 3, wherein the feedstock consists of the mixture of separated coke, residual asphaltene and non-hydrocracked heavy oil.

* * * * *